United States Patent [19]

Morrow

[11] 4,312,404

[45] Jan. 26, 1982

[54] ROTATING BLOWOUT PREVENTER

[75] Inventor: John T. Morrow, Spring, Tex.

[73] Assignee: Lynn International Inc., Conroe, Tex.

[21] Appl. No.: 145,716

[22] Filed: May 1, 1980

[51] Int. Cl.[3] ..... E21B 33/06

[52] U.S. Cl. ..... 166/84; 64/23.5; 166/88; 175/214; 277/31

[58] Field of Search ..... 166/81, 82, 84, 88; 175/195, 210, 214; 277/31; 64/23.5

[56] References Cited

U.S. PATENT DOCUMENTS

| | | | |
|---|---|---|---|
| 2,165,410 | 7/1939 | Penick et al. | 277/31 |
| 2,303,090 | 11/1942 | Pranger et al. | 277/31 |
| 3,128,614 | 4/1964 | Auer | 166/84 X |
| 3,400,938 | 9/1968 | Williams | 175/214 X |
| 3,868,832 | 3/1975 | Biffle | 166/82 X |
| 4,157,186 | 6/1979 | Murray et al. | 277/31 |
| 4,208,056 | 6/1980 | Biffle | 277/31 |

OTHER PUBLICATIONS

Washington Rotating Control Heads, Inc., Brochure, Jun. 16, 1978, Washington, Pa., 2 pages.

*Primary Examiner*—Stephen J. Novosad

*Attorney, Agent, or Firm*—Pravel, Gambrell, Hewitt, Kirk, Kimball & Dodge

[57] ABSTRACT

Improved rotating blowout preventer including a stationary housing, a bearing housing and a bearing means assembly and seal assembly for mounting an internally located, rotating sleeve for rotating, sealable movement within the bearing housing. The bearing housing and rotatable sleeve cooperate to provide a circumferential passageway and radial ports to direct outwardly of the bearing housing any fluid which leaks past the seal assembly. The structure of the seal and bearing mountings provide for replacement of the seal without contaminating the bearing.

7 Claims, 4 Drawing Figures

ROTATING BLOWOUT PREVENTER

BACKGROUND OF THE INVENTION

The field of this invention relates to oil well drilling devices and in particular to an improved rotating blowout preventer.

In oil and gas well drilling, it is typical to mount a rotating blowout preventer on the top of a blowout preventer stack. The rotating blowout preventer generally serves several functions, including the sealing off of the kelly and the diverting of drilling mud into a recirculating mud line. Typically, the mounting of the rotating blowout preventer on the top of a blowout preventer stack locates the rotating blowout preventer just below the rotary table, thus putting it in a difficult position for access for repair. Generally speaking, it is necessary to remove most known rotating blowout preventers entirely from the blowout preventer stack from under the rotary table in order to gain access to the sealing assembly in order to repair or replace the sealing assembly. Removal of the entire rotating blowout preventer from under the rotary table is expensive and time consuming. Generally, it is necessary to replace the seal assembly on a rotating blowout preventer before replacing the bearings, unless the bearings have been contaminated as a result of the leakage through the seal assembly. And, in making repairs to the seal assembly, the possibility of having to replace not only the sealing assembly but also the bearings due to bearing contamination which may occur during repair makes repair of some types of rotating blowout preventers additionally expensive.

The size of a rotating blowout preventer is critical. Most known rotating blowout preventers have an upper, bearing housing which is too large to raise the blowout preventer upwardly through the rotary table for repair.

SUMMARY OF THE INVENTION

It is an object of this invention to provide a new and improved rotating blowout preventer which is capable of being removed through the rotary table and further is capable of seal maintenance separate from bearing maintenance.

These objects and other objects of this invention are carried out by the rotating blowout preventer of the preferred embodiment of this invention adapted to be mounted on a blowout preventer stack and located below the rotary drilling table in an oil well derrick. The rotating blowout preventer of the preferred embodiment of this invention includes a stationary housing adapted to be mounted on a blowout preventer stack, the stationary housing including a main bore adapted to receive a kelly or other piping. The stationary housing further includes a flowline housing portion adapted for connection to a recirculating mud line. A bearing housing which is generally cylindrical in configuration is mounted on the stationary housing and includes a bearing housing bore which is aligned with the main housing bore. A clamp means is provided for removably connecting together the bearing housing and the stationary housing. A rotatable sleeve is positioned within the bearing housing and a bearing means is positioned between the rotatable sleeve and the bearing housing for mounting the rotatable sleeve for rotation with respect to the bearing housing.

A stripper rubber is attached to the bottom of the rotatable sleeve in one embodiment and is mounted concentrically within the rotatable sleeve in another embodiment.

A seal means is provided for mounting between the bearing housing and rotatable sleeve to prevent well fluid from flowing therebetween. The rotatable sleeve and the bearing housing cooperate to provide a leak protection means to isolate the seal means from the bearing means and divert well fluid leaking past the seal means outwardly of the bearing housing.

The features of the new and improved rotating blowout preventer of this invention have only been generally described in this Summary. The specific features are set forth in the detailed specification as follows.

DETAILED DESCRIPTION

Figure 1:
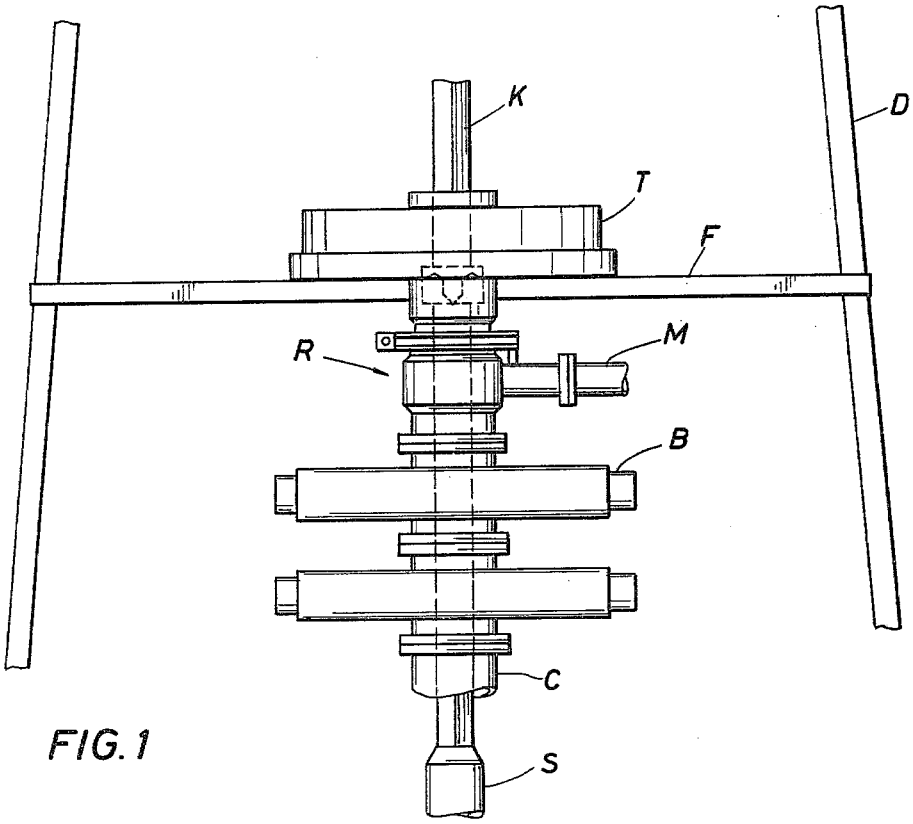
FIG. 1 is a schematic view of a drilling rig showing the position of the rotating blowout preventers of this invention in position for operation.
Figure 2:
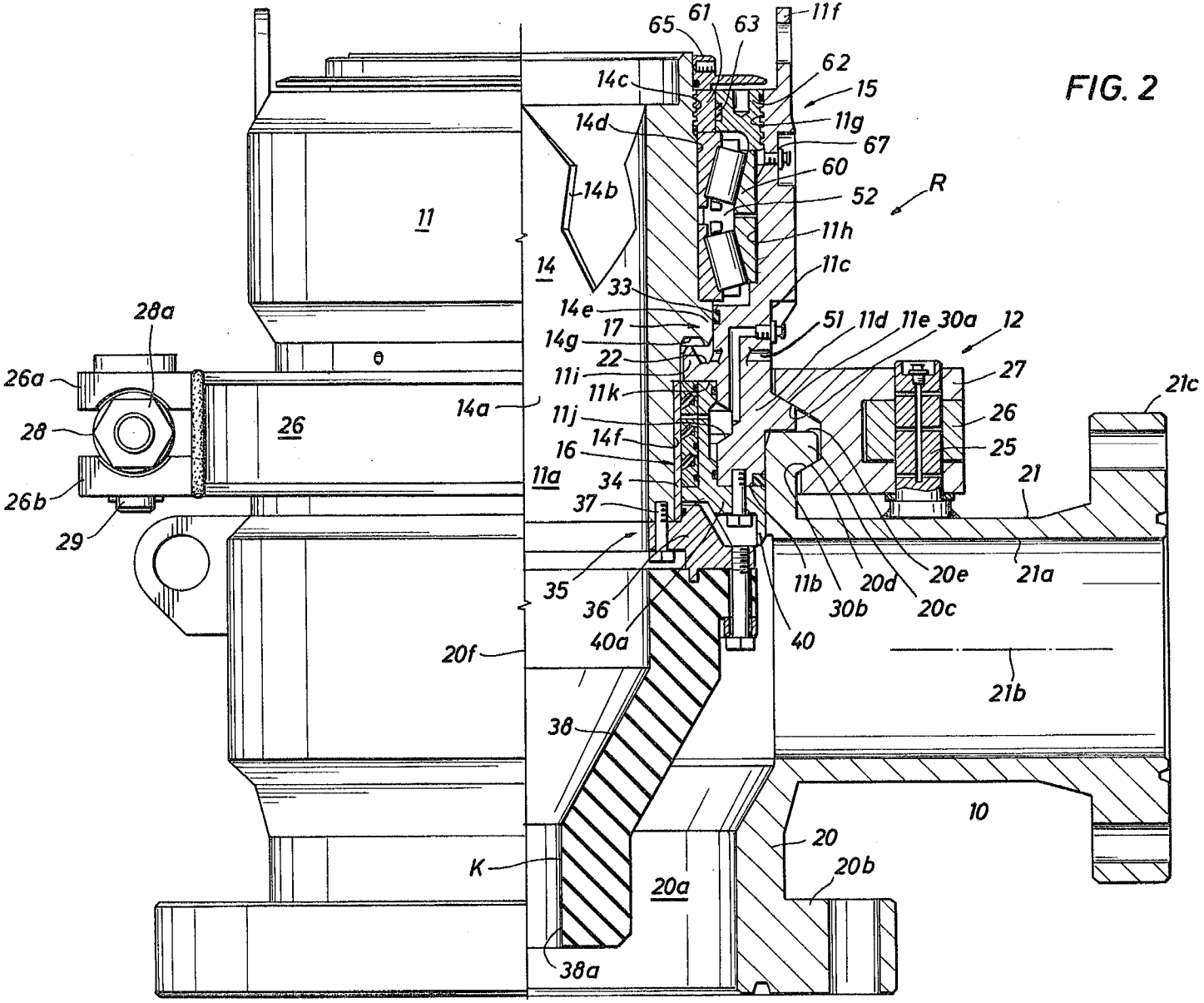
FIG. 2 is a side view partly in section of the rotating blowout preventer of a preferred embodiment of this invention.

Referring to the drawings, the letters R and R-1 represent the rotating blowout preventers of the preferred embodiments of this invention. Referring to FIG. 1, the rotating blowout preventer R, shown in detail in FIG. 2, is illustrated as being mounted for utilization in the drilling of an oil or a gas well. Referring to FIG. 1, the letter D generally designates an oil well drilling derrick having a derrick floor F. A rotary table T is mounted into the derrick floor F. As is known in the art of oil and gas well drilling, the rotary table T includes means for gripping and driving a kelly K which extends from a swivel (not shown) supported by the derrick D, through the rotary table T, the rotating blowout preventer R, and partly through a blowout preventer stack B into a driving connection with a drill string S.

In a typical oil well drilling operation, the kelly K is a multi-sided pipe member which is capable of being gripped by the rotary table T for a driving rotation of the drill string S, which drill string has mounted at the bottom the drill bit which actually drills the hole toward an anxiously anticipated oil reservoir. Typically, drilling fluid, commonly known as "mud" is circulated downwardly through the kelly K and drill string S and outwardly at the bottom of the drill string and is then returned upwardly through the annular area between the drill string S and casing S through the blowout preventer stack B and finally through the rotating blowout preventer R outwardly into the recirculating mud line M.

The functions of a rotating blowout preventer such as R are therefore several. One function is to receive and return the recirculating mud to the recirculating mud line M. Another function of the rotating blowout preventer R is to provide a rotating seal between the kelly K and a stationary housing to insure that none of the mud escapes or blows out through the derrick floor F.

There are several known designs of rotating blowout preventers, some of which, as known to this inventor, have been described in the Background of the Invention and the accompanying Prior Art Statement. The rotating blowout preventers R and R-1 of the preferred embodiments of this invention are particularly suited for assuming a minimum amount of height and diameter in their mounted position upon the blowout preventer stack B and additionally, are uniquely capable of being quickly repaired after removal upwardly through an opening in the rotary table T. It should be understood that the rotating blowout preventers R and R-1 of this invention may also be utilized with certain piping and tools as well as with the kelly K in providing a rotating seal and directing fluid flowing upwardly from the drilling bore hole.

Referring now to FIG. 2, the rotating blowout preventer R will first be described. Basically, the rotating blowout preventer R includes a stationary housing generally designated as 10 having mounted thereon a bearing housing generally designated as 11. As clamping means 12 is provided for removably connecting the bearing housing 11 to the stationary housing 10. A rotatable sleeve 14 is mounted concentrically within the bearing housing 11 for rotation with respect thereto by a bearing means 15. A seal means 16 (illustrated in part in an exploded view in FIG. 3) is mounted with the bearing housing 11 in sealing engagement with the rotatable sleeve 14 to prevent well fluid from flowing between the bearing housing 11 and the rotatable sleeve 14. The rotatable sleeve 14 and the bearing housing 11 cooperate to provide a leak protection means generally designated as 17 to isolate the seal means 16 from the bearing means 15 and to divert well fluid leaking past the seal means outwardly of the bearing housing 11.

Referring in particular to FIG. 2, the stationary housing 10 includes a main cylindrical section 20 having a main bore area 20*a* machined therein and a flowline housing section or portion 21 having a flowline bore area 21*a* machined therein. The main housing section 20 terminates at the bottom with a flange 20*b* which is adapted to be bolted to a corresponding flange on the top blowout preventer of stack B. The main stationary housing section 20 terminates in an upper clamping rim 20*c* which is engaged by the clamping means 12. The clamping rim 20*c* includes a downwardly facing, angled clamping shoulder 30*b* and an upwardly facing transverse annular face 20*e*. The main stationary housing section bore 20*a* may be defined as having a central axis 20*f*, which is transverse to the flowline housing portion bore axis 21*b*. The flowline housing portion 21 terminates in a flange 21*c* adapted to be bolted to the recirculating mud line M.

The bearing housing 11 is generally cylindrical in configuration and has a bearing housing bore 11*a* having the same central axis 20*f* as the main stationary housing section bore 20*a*. The bearing housing 11 is also a stationary housing and includes a bottom annular face 11*b* and an exterior recessed portion 11*c* having clamping rim 11*d* machined therein. The clamping rim 11*d* includes an upwardly facing, tapered clamping shoulder 11*e*. The bearing housing 11 terminates at its upper end in several ears 11*f* having openings for receiving lifting hooks of any type.

Referring now to the interior wall portions of the bearing housing 11, an upper, threaded portion 11*g* is joined to a bearing housing wall portion 11*h*. A series of internally directed shoulders form an internal rim 11*i* having another recess portion 11*j* which is formed by several internal wall portions. The internal rim 11*i* includes a circumferential recess or trough 22 having a plurality of radially directed ports or bores 51 machined therein to provide fluid communication between the circumferential recess 22 and the exterior of the bearing housing 11. The internal rim 11*i* further includes a downwardly facing shoulder 11*k* which is adapted to receive the seal means 16 as will be shortly described.

The clamping means 12 is provided for removably attaching the bearing housing 11 to the stationary housing 10. The clamping means 12 includes a pin 25 which is mounted onto the top of the cylindrical portion of the flowline housing 21 of the stationary housing 10. Opposing semicircular clamping elements or members 26 and 27 are pivotally mounted onto the pin 25 for pivotal movement against the top clamping rim 20*c* of the stationary housing 10 and exterior clamping rim 11*d* of the bearing housing 11 for removably connecting the bearing housing 11 to the stationary housing 10. The semicircular clamping member 26 terminates in vertically spaced locking lugs 26*a* and 26*b*. The semicircular clamping member 27 has a similar set of locking lugs which align with the locking lugs 26*a* and 26*b* when the two clamps are pivoted to the closed position of FIG. 2. The clamping members 26 and 27 are locked together by the swinging bolt 28 which is pivotally mounted onto pin 29 which extends through the locking lug set mounted on the clamping member 27. The bolt 28 is pivoted to the position shown in FIG. 2 and the nut 28*a* is then tightened down to drawn the clamping members 26 and 27 together. Each of the clamping members 26 and 27 includes an upper, inclined clamping shoulder 30*a* which engages the clamping face 11*e* on the bearing housing clamping rim 11*d*. Each of the clamping members 26 and 27 further includes the opposing, inclined clamping shoulders 30*b* which engage the top rim clamping face 20*d* on the stationary housing rim 20*c*. The clamping rim 11*d*, as measured from its outermost point, has a smaller diameter than the top rim 20*c* on the stationary housing 10, if measured from its outermost point. In a corresponding manner, the upper clamping surface 30*a* on the clamping members 26 and 27, as measured from its innermost point or face, has a smaller diameter than the opposing lower clamping surface 30*b* on the clamping members 26 and 27. Stated another way, the annular area of engagement between faces 11*e* and 30*a* has a clamping diameter which is less than the diameter of the annular area of engagement of faces 20*d* and 30*b*. In this manner, the clamping member shoulder 11*e* actually provides effective clamping force within the outer bearing recess portion 11*c*. The positioning of the clamping members 26 and 27 at least partly within the outer bearing recess 11*c* allows the overall diameter of the bearing housing to be smaller than many of the known prior art products. The utilization of the upwardly inclined surfaces (as measured right to left) 11*e* and 30*a* in cooperation with the utilization of downwardly inclined clamping surfaces 30*b* and 20*d* serve to push the bearing housing rim 11*d* against the upper housing rim 20*c* thus providing force vectors which are both radial and vertical to press and maintain the bearing housing 11 against the stationary housing 10.

The rotatable sleeve 14 is positioned within the bearing housing bore 20*a* and has a cylindrical inner wall 14*a* which forms a bore having a central axis 20*f* common to the bearing housing 11. The rotatable sleeve's interior wall 14*a* is a smooth cylinder. The upper part of the rotatable sleeve 14*a* includes a plurality of slots 14*b* which are adapted to receive the solid outside ring of a kelly drive unit in a known manner. In this manner, the rotatable sleeve 14 rotates with the kelly, which is driven by the rotary table T schematically illustrated in FIG. 1.

The outside wall of the rotatable sleeve 14 includes a threaded portion 14*c*, a bearing wall portion 14*d*, a seal rim 14*e* and a seal face 14*f*. The seal rim 14*e* is formed by an upwardly facing transverse surface, an annular wall surface and a downwardly facing recessed area 14*g*. The downwardly facing recessed area 14*g* which forms the bottom part of the rim 14*e* is positioned adjacent to and just above the circumferential recess 22 on the bearing housing 11 and forms part of the leak protection means 17.

A seal ring 33 is machined in an internal face of the bearing housing above the circumferential recess 22 for sealing engagement against the outside face of the seal rim 14*e* on the rotatable sleeve 14. The seal 33 acts to isolate the bearing means 15 from the seal means 16 and forms part of the seal protection means 17.

A wear liner or sleeve 34 is mounted against the rotatable sleeve seal face 14*f* and forms part of the seal means generally designated at 16.

Means generally designated as 35 are mounted onto the bottom of the rotatable sleeve 14 for the dual purpose of mounting the stripper rubber 38 and for mounting the wear sleeve 34 in slight compression. The mounting means 35 is a generally annular adapter plate 36 which is bolted onto the bottom of the rotatable sleeve 14 by a series of bolts such as 37. The annular upper face of the adapter plate 36 which actually abuts the bottom face of the rotatable sleeve 14 also engages the bottom of the wear sleeve 34, which fits against an upper shoulder 14*g* which adjoins the rotatable sleeve outer seal face 14*f*. When the adapter plate 36 is bolted in place, the upper face engaging the wear sleeve 34 presses the wear sleeve 34 against an opposing shoulder on the rotatable sleeve 14 and compresses the wear sleeve in position against the sleeve face 14*f*. In this manner, the wear sleeve 34 is mounted for rotation with the rotatable sleeve 14 and yet may be removed by removing the adapter plate 36 for easy replacement. In prior art products, it has generally been necessary to press fit a similar type of wear sleeve in position, which means that the wear sleeve can only be removed by a much more difficult procedure which generally can only take place at a machine shop.

The adapter plate 36 has bolted to the bottom thereof the stripper rubber 38 which is of a generally known configuration which narrows down to sealably fit against the kelly K, pipe or tool extending through the rotating blowout preventer R. The stripper rubber 38 in FIG. 1 is actually mounted below the rotatable sleeve 14 by the adapter plate 36 and effectively seals against the kelly K at interior sealing face 38*a*.

The seal means 16 is mounted between the bearing housing 11 and the rotatable sleeve 14 to prevent the passage of fluid therebetween. The seal means 16 includes a packing support 40 which is L-shaped in the cross-sectional view of FIG. 2 and is of course generally cylindrical in its total configuration. The L-shaped packing support 40 includes a first portion 40*a* which is bolted to the bottom face 11*b* of the bearing housing 11 and a second portion 40*b* which extends upwardly and is positioned between the bearing housing 11 and the wear sleeve 34. The vertically, upwardly extending packing support portion 40*b* has mounted therein two O-ring seals which seal against adjacent faces of the internal recessed portion 11*j* of the bearing housing 11. Another ring-type of seal is located in the bottom face 11*b* of the bearing housing 11 for sealable engagement against the top face of the packing support portion 40*a* and against an annular face of the top stationary housing rim 20*c*.

Figure 3:
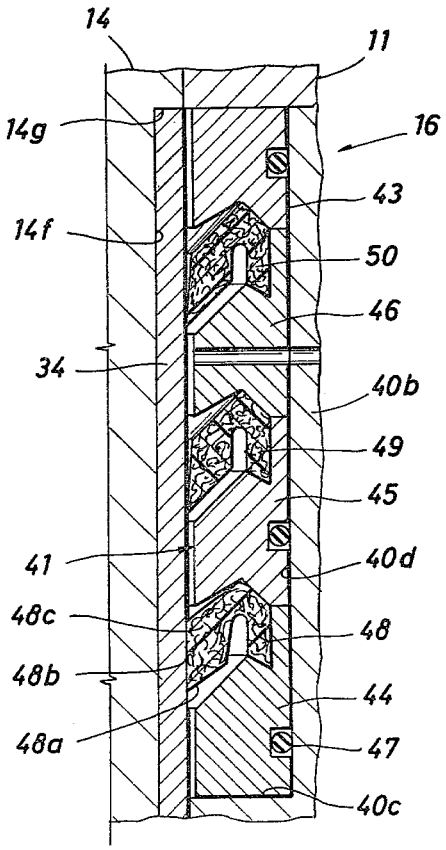
FIG. 3 is an exploded view of a portion of the seal means illustrating the sequential sealing operation of the seal rings of the seal means of the rotating blowout preventer of FIGS. 2 and 4.

Referring to FIG. 3, the vertical portion 40*b* of the L-shaped packing support 40 supports a sealing ring assembly generally designated as 41. The vertically oriented packing support portion 40*b* includes a sealing ring recess formed by internal shoulder 40*c* and the vertical internal face 40*d*. The sealing ring assembly 41 mounted therein includes a top packing ring 43, bottom packing ring 44 and intermediate packing rings 45 and 46, all of which are metal. Each of these packing rings include an O-ring such as 47 to sealably engage the packing surface support 40*d*. Mounted in between each of the metal packing rings are rubber packing elements 48, 49 and 50. The rubber packing element 48 includes a lower, inclined surface 48*a* against which fluid pressure acts to force inside packing ring face 48*b* against the rotating wear sleeve 34 thereby creating a seal therebetween. This shape of packing element is particularly useful because the pressure acts to cause the inside segment 48*c* of each packing element to flex to force the interior sealing face 48*b* against the wear sleeve 34. The packing rings 48, 49 and 50 are vertically spaced so that the rings effectively seal sequentially to thereby increase the effective life of the seal assembly 41. Thus, the lower packing ring 48 operates as the sealing ring to prevent the passage of fluid between the packing ring 48 and the wear sleeve 34 until it wears out or otherwise fails. At that time, pressure from the well leaks past the packing ring 48 and activates the seal ring 49.

After each of the seal rings 48, 49 and 50 have partially or fully failed, well fluid leaks upwardly between the interior bearing housing rim 11*i* and the rotatable sleeve 14 and leaks into the circumferential recess 22 machined in the bearing housing rim 11*i*. The upper circumferential recess or trough 14*g* in the rotatable sleeve 14 serves to confine and direct any leaking fluid down into the circumferential bearing housing recess 14*g*. The leaking fluid flows from the circumferential recess 14*g* outwardly through one or more of a series of circumferentially spaced, radially directed ports 51, thereby avoiding clogging or caking of drilling fluid in the area between the bearing housing and the rotating sleeve.

Thus the leak protection means, which has been generally designated by the number 17, includes a combination of structure found on the bearing housing 11 and on the rotatable sleeve 14, which structure cooperates to isolate the bearing means 15 from fluid leaking past the seal means 16 and divert any leaking fluid outwardly of the housing 11. The leaking well fluid is diverted outwardly of the housing 11 through flow of the fluid into the bearing housing recess or trough 22 and outwardly of the radial ports 51. An operator may look to the ports 51 from the outside to thereby aid in the determination as to the presence of a leak, which allows the leak protection means 17 to act as an early warning detector of problems with the seal assembly 16. The downwardly facing circumferential recess 14*g* formed in the rotatable sleeve rim 14*e* cooperates with the upwardly facing circumferential recess 22 in bearing housing rim 11*i* to form a circumferential passageway to confine leaking fluid thereto so that the leaking fluid will eventually flow out of the radial ports or bores 51. The seal 33 acts between the bearing housing 11 and the rim 14*e* of the rotatable sleeve 14 to prevent the passage of fluid into the area of the bearing means 15.

The bearing means 15 is a standard thrust bearing 60 which may be of any suitable variety. The thrust bearing 60 is located between interior face 11*h* and the exterior bearing face 14*d* on the rotatable sleeve 14 in a bearing chamber 52 created by such faces, which bearing chamber is isolated from the seal means 16 below by the leak protection means 17, which includes the sealing ring 33. The bearing chamber 52 formed between faces 11*h* and 14*d* and isolated by seal 33 is further sealed off from the exterior by means of retainer rings 61 and 62. The retainer ring 61 is threadedly mounted to rotatable sleeve threaded area 14*c*, and the retainer ring 62 is threadedly mounted to the bearing housing internal threaded portion 11*g*. A seal 63 is located between the retainer rings 61 and 62 and O-ring seals are provided at the threaded connections between the retainer rings and the bearing housing and rotatable sleeve, respectively, to form the sealed bearing chamber 52, whose integrity is protected unless the retainer rings 61 and 62 are removed. An oil slinger ring 65 is mounted above the retainer rings 61 and 62 and is held in place by suitable set screws. The bearing chamber 52 in which the bearing 60 is mounted may be filled with oil through the bearing oil inlet 67. In this manner, the bearing 60 is sealed off from contamination, such isolation of the bearing 60 allowing for replacement of the bearing without contamination or removal of the seal means 16, and vice versa.

Referring now to FIG. 3, the rotating blowout preventer R-1 is basically identical to the rotating blowout preventer R except that the rotating blowout preventer R-1 is designed even more compactly than the unit R. The overall height of the unit R-1 is less than the unit R. In addition, the overall diameter of the main cylindrical part of the R-1 unit may be even less than that of the unit R so that the R-1 unit can be even more easily removed through the rotary table. The rotating blowout preventer R-1 will now be described in only sufficient detail necessary to point out additional or different features of the R-1 unit over the unit R.

The stationary housing 110 of unit R-1 again includes a main housing section 120 and a flowline housing section 121. A bearing housing 111 is removably mounted onto top rim 120*c* of the main housing section 120 by the clamping means 12.

A rotatable sleeve 114 is mounted for sealed rotation within the bearing housing 11 by a bearing means generally designated as 115 and a seal means generally designated as 116. The rotatable sleeve 114 is formed of two internal vertical faces 101*a* and 101*b* joined by shoulder 101*c*. The rotatable sleeve 114 again provides a series of upwardly facing recesses 114*b* to receive a kelly drive unit. A retainer ring 161 is mounted onto an upper threaded portion 114*c* of the rotatable sleeve 114. A plurality of bolts mounts a stripper rubber mounting ring 102 onto the retainer ring 161. The stripper rubber retainer ring 102 extends downwardly into the inside of the rotatable sleeve 114 and engages rim 138*b* of the stripper rubber 138. In the embodiment R-1, the stripper rubber 138 is located concentrically within the rotatable sleeve 114 in order to make the unit R-1 even more compact than the unit R wherein the stripper rubber 38 depends downwardly from the rotatable sleeve 14.

Figure 4:
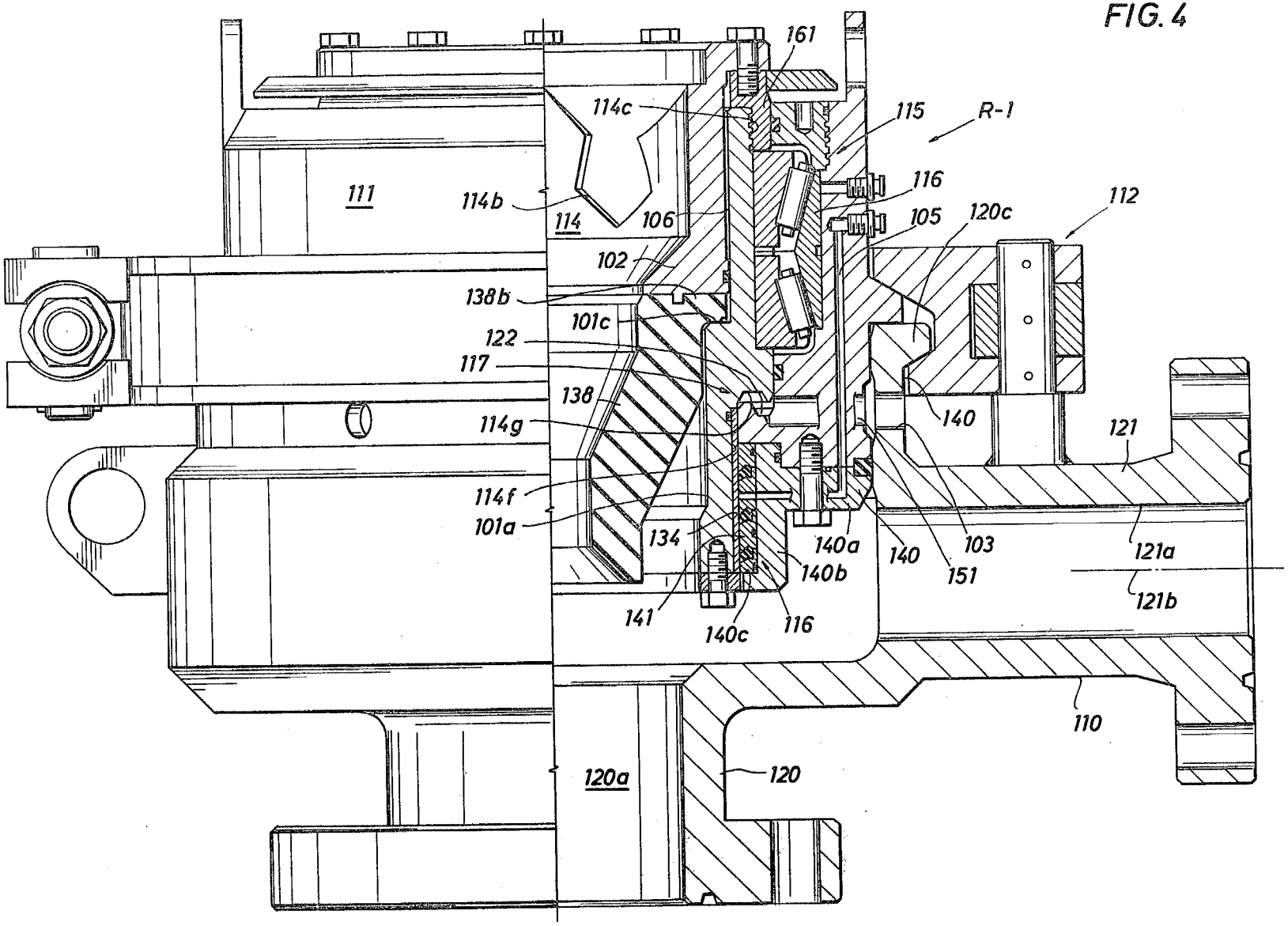
FIG. 4 is a side view partly in section of an alternate embodiment of the rotating blowout preventer of this invention.

The wear sleeve 134 is again mounted on a wear sleeve face 114*f* of the rotatable sleeve 114 and provides part of the seal means 116. The seal means 116 differs from the seal means 16. The seal means 116 includes a horizontal portion 140*a* and a substantially vertically depending portion 140*b*. The horizontal portion 140*a* is bolted to the bottom of the bearing housing 111 while the vertical portion 140*b* depends downwardly therefrom and forms a ledge 140*c* which mounts packing ring assembly 141 thereon. The packing ring assembly 141 is identical to the packing ring assembly 41 of the unit R and thus sealably engages the wear sleeve 134 as illustrated in FIG. 4. Here, the packing ring assembly support 140 depends down into and is intersected by the axis 121*b* of the flowline bore 120*a* of flowline housing portion 121. It is therefore clear that the seal means 116 is located at a relatively lower point in the housing bores 120*a* and 121*b* than was the seal assembly 16 for the unit R.

The leak protection means 117 is basically identical to the leak protection means 17 of the unit R in that a circumferential recess 122 is machined into the bearing housing to cooperate with a downwardly facing circumferential recess 114*g* to provide a passageway to a plurality of circumferentially spaced radially directed ports 151. In the unit R-1, an additional hole 103 is machined in the cylindrical body portion 104 of the main housing portion 120 for allowing fluid leaking past the seal means 116 to flow outwardly not only of the bearing housing 111, but also outwardly of the stationary housing main portion 120. It is noted that the radial bores 151 are located below the clamping means 112 in the unit R-1 as compared to the openings 51 of the unit R, which were located above the clamping means 12.

The bearing housing 111 includes a bore 105 which extends vertically and horizontally into the packing ring assembly 141 in order to pressurize the packing ring assembly if desired. The bearing 160 for the bearing means or assembly 115 is basically mounted identically to the bearing means 15 of the unit R.

The foregoing disclosure and description of the invention are illustrative and explanatory thereof, and various changes in the size, shape and materials as well as in the details of the illustrated construction may be made without departing from the spirit of the invention.

I claim:

1. A new and improved rotating blowout preventer adapted to be mounted on a blowout preventer stack located below a rotating drilling table in an oil well derrick floor, comprising:

a stationary housing adapted to be mounted on a blowout preventer stack, said stationary housing including a main bore adapted to receive a kelly or other piping;

said stationary housing further including a flowline housing portion adapted for connection to a recirculating flowline, said flowline housing having a bore directed transversely to the main stationary housing bore;

a bearing housing generally cylindrical in configuration and having a bearing housing bore axially aligned with said main stationary housing bore;

clamp means for removably connecting said bearing housing to said stationary housing;

a rotatable sleeve positioned within said bearing housing bore and bearing means positioned between said rotatable sleeve and said bearing housing and mounting said rotatable sleeve for rotation with respect to said bearing housing;

a stripper rubber and means attaching said stripper rubber to said rotatable sleeve for rotation therewith;

seal means mounted with said bearing housing in sealing engagement with said rotatable sleeve to prevent well fluid from flowing between said bearing housing and said rotating sleeve;

said rotating sleeve and said bearing housing cooperating to provide leak protection means to isolate said seal means from bearing means and divert well fluid leaking past said seal means outwardly of said bearing housing;

and said bearing housing and said rotating housing cooperating to form a circumferential passageway located between said seal means and said bearing means, said bearing housing forming a lower portion and said rotating housing forming an upper portion of said circumferential passageway and a plurality of radial passageways located in said bearing housing in fluid communication with said circumferential passageway for directing outwardly of said bearing housing well fluid leaking past said seal means.

2. The structure set forth in claim 1, wherein said seal means includes:

a sealing assembly support member including a first portion attached to the bottom of said bearing housing and a second portion integrally formed with said first portion and positioned substantially between said bearing housing and said rotating sleeve; and a seal ring assembly mounted onto said second support assembly portion for sealably engaging said rotating sleeve.

3. The structure set forth in claim 1, including:

said means attaching said stripper rubber to said rotatable sleeve including means for compressively mounting a wear sleeve on said rotating sleeve for engaging said seal means mounted on said bearing housing.

4. A new and improved rotating blowout preventer adapted to be mounted on a blowout preventer stack located below a rotating drilling table in an oil well derrick floor, comprising:

a stationary housing adapted to be mounted on a blowout preventer stack, said stationary housing including a main bore adapted to receive a kelly or other piping;

said stationary housing further including a flowline housing portion adapted for connection to a recirculating flowline, said flowline housing having a bore directed transversely to the main stationary housing bore;

a bearing housing generally cylindrical in configuration and having a bearing housing bore axially aligned with said main stationary housing bore;

clamp means for removably connecting said bearing housing to said stationary housing;

a rotatable sleeve positioned within said bearing housing bore and bearing means positioned between said rotatable sleeve and said bearing housing and mounting said rotatable sleeve for rotation with respect to said bearing housing;

a stripper rubber and means attaching said stripper rubber to said rotatable sleeve for rotation therewith;

seal means mounted with said bearing housing in sealing engagement with said rotatable sleeve to prevent well fluid from flowing between said bearing housing and said rotating sleeve;

said rotating sleeve and said bearing housing cooperating to provide leak protection means to isolate said seal means from bearing means and divert well fluid leaking past said seal means outwardly of said bearing housing;

a bearing assembly positioned between said bearing housing and said rotatable sleeve; and first and second retainer rings threadedly attached to said rotatable sleeve and to said bearing housing, respectively, for rotation with respect to each other and having a retainer seal ring therebetween to cooperate with said leak protection means to seal off said bearing assembly from the undesirable entry of well fluid, said bearing assembly being accessible for maintenance by the removal of said retainer rings.

5. A new and improved rotating blowout preventer adapted to be mounted on a blowout preventer stack located below a rotating drilling table in an oil well derrick floor, comprising:

a stationary housing adapted to be mounted on a blowout preventer stack, said stationary housing including a main bore adapted to receive a kelly or other piping;

said stationary housing further including a flowline housing portion adapted for connection to a recirculating flowline, said flowline housing having a bore directed transversely to the main stationary housing bore;

a bearing housing generally cylindrical in configuration and having a bearing housing bore axially aligned with said main stationary housing bore;

clamp means for removably connecting said bearing housing to said stationary housing;

a rotatable sleeve positioned within said bearing housing bore and bearing means positioned between said rotatable sleeve and said bearing housing and mounting said rotatable sleeve for rotation with respect to said bearing housing;

a stripper rubber and means attaching said stripper rubber to said rotatable sleeve for rotation therewith;

seal means mounted with said bearing housing in sealing engagement with said rotatable sleeve to prevent well fluid from flowing between said bearing housing and said rotating sleeve;

said rotating sleeve and said bearing housing cooperating to provide leak protection means to isolate said seal means from bearing means and divert well fluid leaking past said seal means outwardly of said bearing housing;

a sealing assembly support member including a first portion attached to the bottom of said bearing housing and a second portion positioned substantially below said bearing housing and concentrically outside said rotating sleeve;

a seal ring assembly mounted onto said second support assembly portion for sealably engaging said rotating sleeve; and means attaching said support member to said bearing housing for removal of said seal means without affecting said bearing means.

6. The structure set forth in claim 5, including:

a cylindrical mounting ring positioned within said rotating sleeve and having recesses adapted to receive a kelly driving ring, said mounting ring and said rotatable sleeve cooperating to provide emans mounting said stripper rubber substantially concentrically within said rotatable sleeve.

7. A new and improved rotating blowout preventer adapted to be mounted on a blowout preventer stack located below a rotating drilling table in an oil well derrick floor, comprising:

a stationary housing adapted to be mounted on a blowout preventer stack, said stationary housing including a main bore adapted to receive a kelly or other piping;

said stationary housing further including a flowline housing portion adapted for connection to a recirculating flowline, said flowline housing having a bore directed transversely to the main stationary housing bore;

a bearing housing generally cylindrical in configuration and having a bearing housing bore axially aligned with said main stationary housing bore;

clamp means for removably connecting said bearing housing to said stationary housing;

a rotatable sleeve positioned within said bearing housing bore and bearing means positioned between said rotatable sleeve and said bearing housing and mounting said rotatable sleeve for rotation with respect to said bearing housing;

a stripper rubber and means attaching said stripper rubber to said rotatable sleeve for rotation therewith;

seal means mounted with said bearing housing in sealing engagement with said rotatable sleeve to prevent well fluid from flowing between said bearing housing and said rotating sleeve;

said rotating sleeve and said bearing housing cooperating to provide leak protection means to isolate said seal means from bearing means and divert well fluid leaking past said seal means outwardly of said bearing housing; and said circumferential passageways are positioned below said claimp means and include passageways extending through said stationary housing.

* * * * *

UNITED STATES PATENT AND TRADEMARK OFFICE

CERTIFICATE OF CORRECTION

PATENT NO. : 4,312,404

DATED : January 26, 1982

INVENTOR(S) : John T. Morrow

It is certified that error appears in the above-identified patent and that said Letters Patent are hereby corrected as shown below:

In column 2, line 58, delete "casing S" and insert --casing C--.

In column 3, line 21, delete "As" and insert --A--.

In column 5, line 25, delete "at" and insert --as--.

In column 7, line 52, delete "11" and insert --111--.

In column 11, line 9, delete "emans" and insert --means--.

Signed and Sealed this

*First* Day of *June 1982*

[SEAL]

*Attest:*

GERALD J. MOSSINGHOFF

*Attesting Officer*

*Commissioner of Patents and Trademarks*